US008482477B2

(12) United States Patent
Price et al.

(10) Patent No.: US 8,482,477 B2
(45) Date of Patent: Jul. 9, 2013

(54) FOAM LAYER TRANSMISSION LINE STRUCTURES

(75) Inventors: Devon J. Price, Cambridge, MA (US); Jose C. Melendez, San Mateo, CA (US); Larry L. Lai, Walnut, CA (US)

(73) Assignee: Raytheon Company, Waltham, MA (US)

( * ) Notice: Subject to any disclaimer, the term of this patent is extended or adjusted under 35 U.S.C. 154(b) by 525 days.

(21) Appl. No.: 12/660,996

(22) Filed: Mar. 9, 2010

(65) Prior Publication Data

US 2011/0221649 A1 Sep. 15, 2011

(51) Int. Cl.
*H01Q 1/50* (2006.01)

(52) U.S. Cl.
USPC ..... 343/850

(58) Field of Classification Search
USPC ..... 333/238, 260; 343/850, 700 MS, 343/749, 752
See application file for complete search history.

(56) References Cited

U.S. PATENT DOCUMENTS

| | | | | |
|---|---|---|---|---|
| 3,135,935 | A | 6/1964 | Engelbrecht | |
| 5,724,012 | A * | 3/1998 | Teunisse | 333/238 |
| 6,064,347 | A * | 5/2000 | Fordham | 343/749 |
| 6,366,185 | B1 | 4/2002 | Keesey et al. | |
| 6,414,573 | B1 | 7/2002 | Swineford et al. | |
| 6,603,376 | B1 * | 8/2003 | Handforth et al. | 333/238 |
| 6,703,114 | B1 | 3/2004 | Guiles et al. | |
| 6,809,608 | B2 * | 10/2004 | Fjelstad | 333/1 |
| 6,972,647 | B1 * | 12/2005 | Handforth et al. | 333/238 |
| 7,999,638 | B2 * | 8/2011 | Niman et al. | 333/238 |
| 2002/0062982 | A1 | 5/2002 | Nagel et al. | |

FOREIGN PATENT DOCUMENTS

| | | |
|---|---|---|
| EP | 1 041 665 A1 | 10/2000 |
| FR | 1251973 A | 1/1961 |

OTHER PUBLICATIONS

Uhlig, P. et al., "Light Weight-Low Loss Beam Forming Networks for Space Applications", Antennas and Propagation, 2009 3rd European Conference on IEEE, Mar. 23, 2009 (pp. 740-744).
Extended European Search Report for European Application No. 11157334.1, Extended European Search Report dated Jun. 23, 2011 and mailed Jun. 30, 2011 (8 pgs.).

* cited by examiner

*Primary Examiner* — Huedung Mancuso
(74) *Attorney, Agent, or Firm* — Christie, Parker & Hale, LLP

(57) ABSTRACT

A transmission line structure for propagating electromagnetic energy includes a transmission line conductor trace, a first dielectric foam layer and a second dielectric foam layer. The conductor trace is sandwiched between the first foam layer and the second foam layer. A first ground plane layer and a second ground plane layer sandwich the first foam layer, the conductor pattern and the second foam layer.

23 Claims, 4 Drawing Sheets

FOAM LAYER TRANSMISSION LINE STRUCTURES

BACKGROUND

Very low mass or ultra-lightweight (ULW) antenna designs are desired for some applications, such as, by way of example only, space applications including micro-satellite radar applications. Conventional antenna array and transmission line technology provides significant weight and other challenges to use in such ULW arrays.

SUMMARY OF THE DISCLOSURE

A transmission line structure for propagating electromagnetic energy, includes a transmission line conductor trace, a first dielectric foam layer and a second dielectric foam layer. The conductor trace is sandwiched between the first foam layer and the second foam layer. A first ground plane layer and a second ground plane layer sandwich the first foam layer, the conductor trace and the second foam layer. A plurality of mode suppression metallic element portions pass through the first ground plane layer, the first foam layer, the second foam layer and the second ground plane layer in a generally transverse arrangement.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
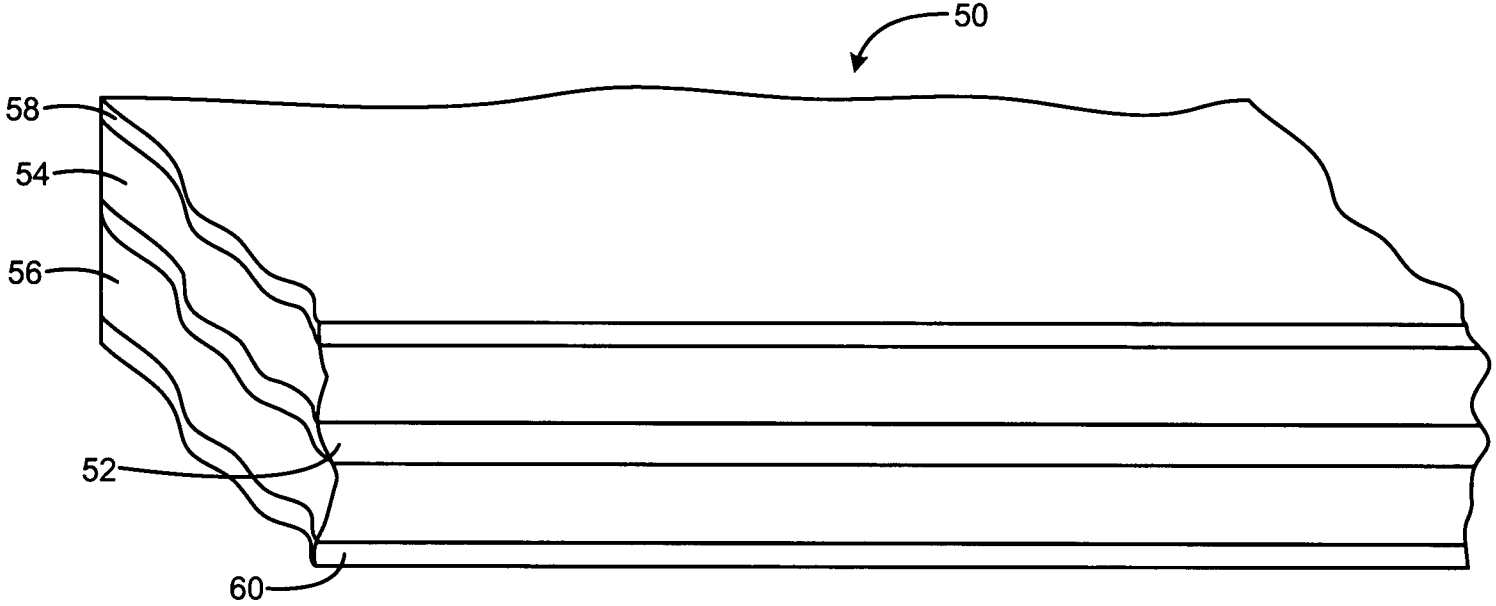
FIG. 1 diagrammatically depicts an exemplary embodiment of a stripline transmission line with foam dielectric layers.

In the following detailed description and in the several figures of the drawing, like elements are identified with like reference numerals. The figures are not to scale, and relative feature sizes may be exaggerated for illustrative purposes.

FIG. 1 illustrates features of an exemplary embodiment of a foam-loaded stripline transmission structure 50. The exemplary embodiment 50 is a five layer composite or stack-up structure. A circuit layer 52 carrying a stripline conductor pattern is at the center of the stack-up. In an exemplary embodiment, the circuit layer may be formed by a flexible circuit layer, e.g. formed on a Kapton® sheet on which a copper conductor pattern has been defined. The circuit layer 52 is sandwiched between dielectric lightweight foam layers 54 and 56. An exemplary lightweight foam material is ROHACELL® 31 HF, closed-cell rigid foam plastic. Other exemplary lightweight foam materials include Solrex® 6.0 and Rohacell® 31 IG. Desired foam characteristics are a low loss tangent value and a low dielectric constant. Examples of these desired electrical properties for a given frequency of 2 GHz are nominally less than 0.002 for loss tangent, and 1.05 for the dielectric constant. In addition, for one exemplary embodiment, the foam preferably is ultra light weight, e.g. under 3 pounds per cubic foot.

The foam layers 54, 56 are in turn sandwiched between ground planes 58 and 60. The ground planes may be formed, in one embodiment, by a copper metalized layer on a face sheet or substrate, e.g., a liquid crystal polymer (LCP) substrate, such as R/Flex® 3600 copper-clad LCP marketed by the Rogers Corporation.

Unsupported cyanate ester film adhesive (0.015 psf) may be used as an adhesive to bond the layers of the stack-up together in an exemplary embodiment. Other adhesives may be alternatively be used, such as silicone CV-2500 and epoxy EA 9396.

In another exemplary embodiment, the ground planes 58 and 60 are formed by layers of metal deposited directly on the outwardly facing surfaces of the foam layers 54 and 56, e.g. by an evaporation technique such as electron beam ("e-beam") evaporation of a metal such as aluminum. This eliminates the weight and RF loss of the adhesive and the LCP carrier of the ground plane layers fabricated by copper-clad LCP.

Figure 2:
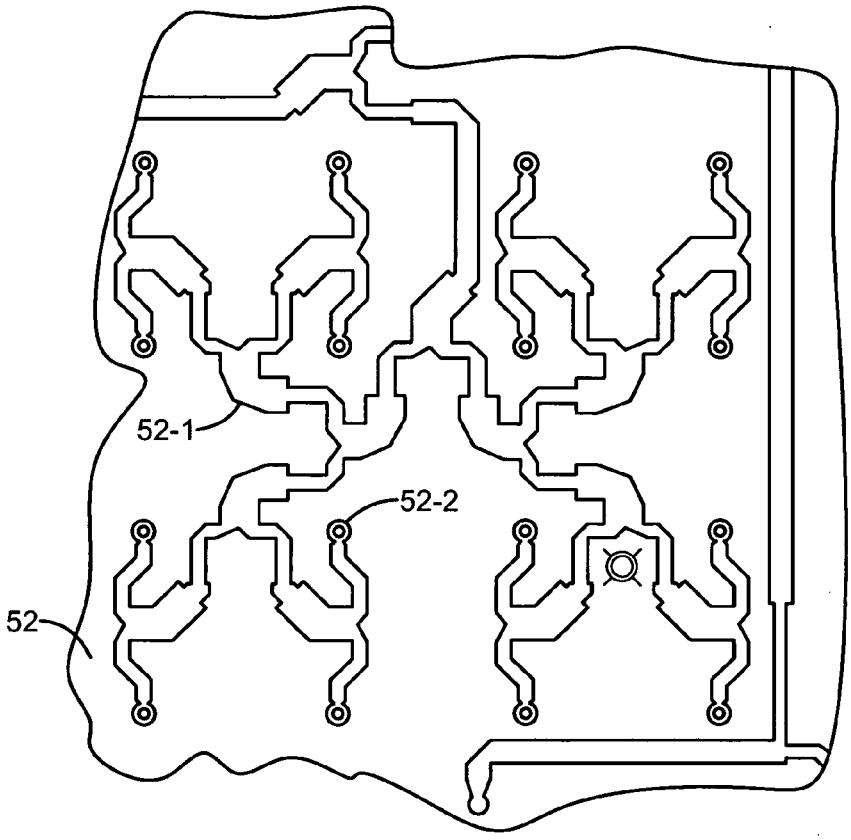
FIG. 2 is a diagrammatic top view illustration of an exemplary stripline conductor pattern.

The stripline transmission line structure may be used to implement various circuits, e.g., as part of an antenna array. FIG. 2 illustrates a fragment of an exemplary stripline conductor pattern 52-1 which may be defined by circuit layer 52. In this embodiment, the conductor pattern may be defined by copper traces formed on or within a dielectric substrate. The pattern may form transmission lines, power divider/combiners and the like. Pads such as pad 52-2 may be provided as connection points to a conductive via connection or vertical interconnection. Exemplary frequencies of operation for the foam-loaded RF transmission line range from S-band (e.g. 2 GHz) to X-band (e.g. 8 GHz). Other applications may expand the frequency up to Ka-band (e.g., 38 GHz). This foam layer construction can also be used in microstrip circuits. The foam layer forms the microstrip dielectric substrate layer, with the microstrip conductor formed on a first surface of the foam layer, and a ground plane layer formed on the opposed second surface of the foam layer. In the case of a sandwiched multilayer construction, an air channel may be formed above the microstrip conductor, e.g. by routing out a portion of a second foam layer sandwiched over the first surface of the microstrip foam layer substrate.

Associated with the foam-loaded stripline structures is a technique to provide trace isolation and parallel plate mode suppression. In a typical PWB microstrip transmission line structure, isolation and mode suppression are accomplished by inserting plated vias in the substrate to electrically connect the top and bottom ground planes at precise points. Two methods of mode suppression suitable for foam-loaded stripline structures include copper stitching, and plated vias in the foam layers.

Foam stitching accomplishes trace isolation and mode suppression by electrically connecting the top and bottom ground planes of the foam stack-up with copper wire or ribbon. The wire may be "sewn" through the foam stack up and bonded in place. The vertical vias or stitch segments may be placed to form conductive boundary walls or picket structures along a stripline conductor or to surround a vertical via to form a coaxial cage-like structure around the via and form a vertical interconnect.

Figure 3:
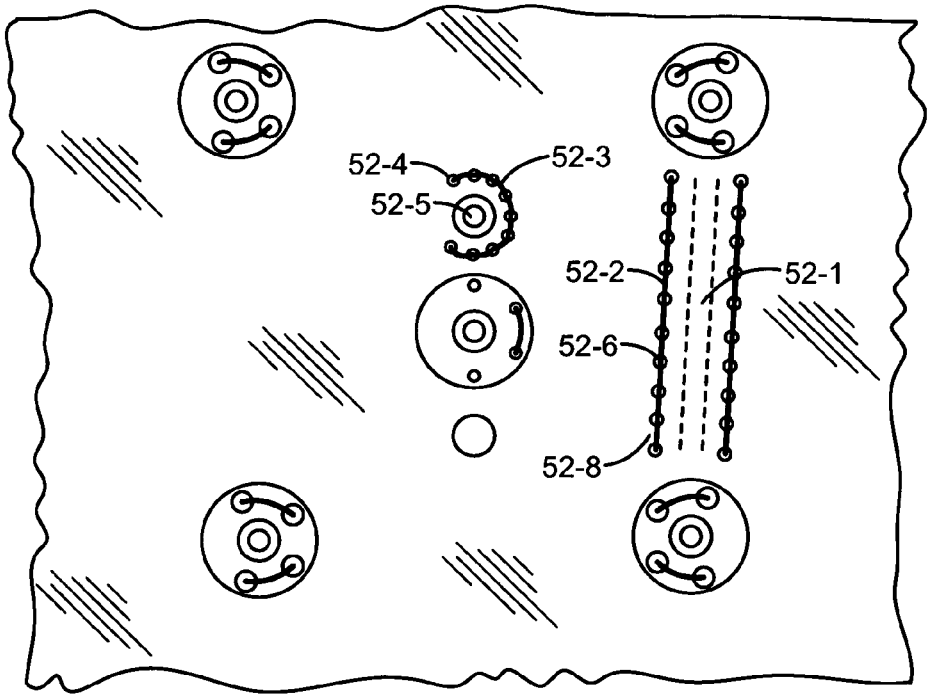
FIG. 3 depicts an exemplary embodiment of a stitched cage-like structure around a vertical via.

FIG. 3 illustrates exemplary trace isolation and mode suppression features, defined along stripline conductor 52-2, by metal wiring 52-7 passed through holes 52-6 formed in the ground plane layers and foam layers, as well as the substrate 52, in a stitched arrangement, to form picket structures 52-8 as conductive boundary walls on opposite sides of the conductor 52-1.

FIG. 3 depicts an exemplary embodiment of a stitched cage-like structure around a vertical via 52-5. The cage-like structure 52-3 is formed by a continuous wire 52-4 passed between the top and bottom ground planes 56, 58, and then bonded in place.

Methods to stitch the foam stack-up include hand sewing through pre-placed holes, and machine sewing using, for example, an industrial sewing machine. Hand sewing involves the use of a needle threaded with the copper wire or ribbon, and inserting the needle and wire through the pre-formed holes in the stack-up. An exemplary machine suitable for machine sewing is the Singer 17U with a long beak high point shuttle, which minimizes damage to the wire and stripline assembly. Hand sewing allows for more precise stitch placement while the machine is considerably more efficient. Stitch bonding processes included hand solder, solder re-flow with paste and pre-forms, conductive epoxy and tape.

Plating vias in the foam stack-up may also be employed as an effective method for mode suppression and trace isolation in a foam stripline transmission line structure. An exemplary process may employ sputter deposition to metallize the interior of pre-drilled holes, or e-beam evaporation. In an exemplary application, e.g. for a 0.130" thick transmission line stack-up structure, sputter deposition may be preferred to e-beam evaporation as it allows for a wider angle of attack and better coating of the walls of the holes.

Figure 4:
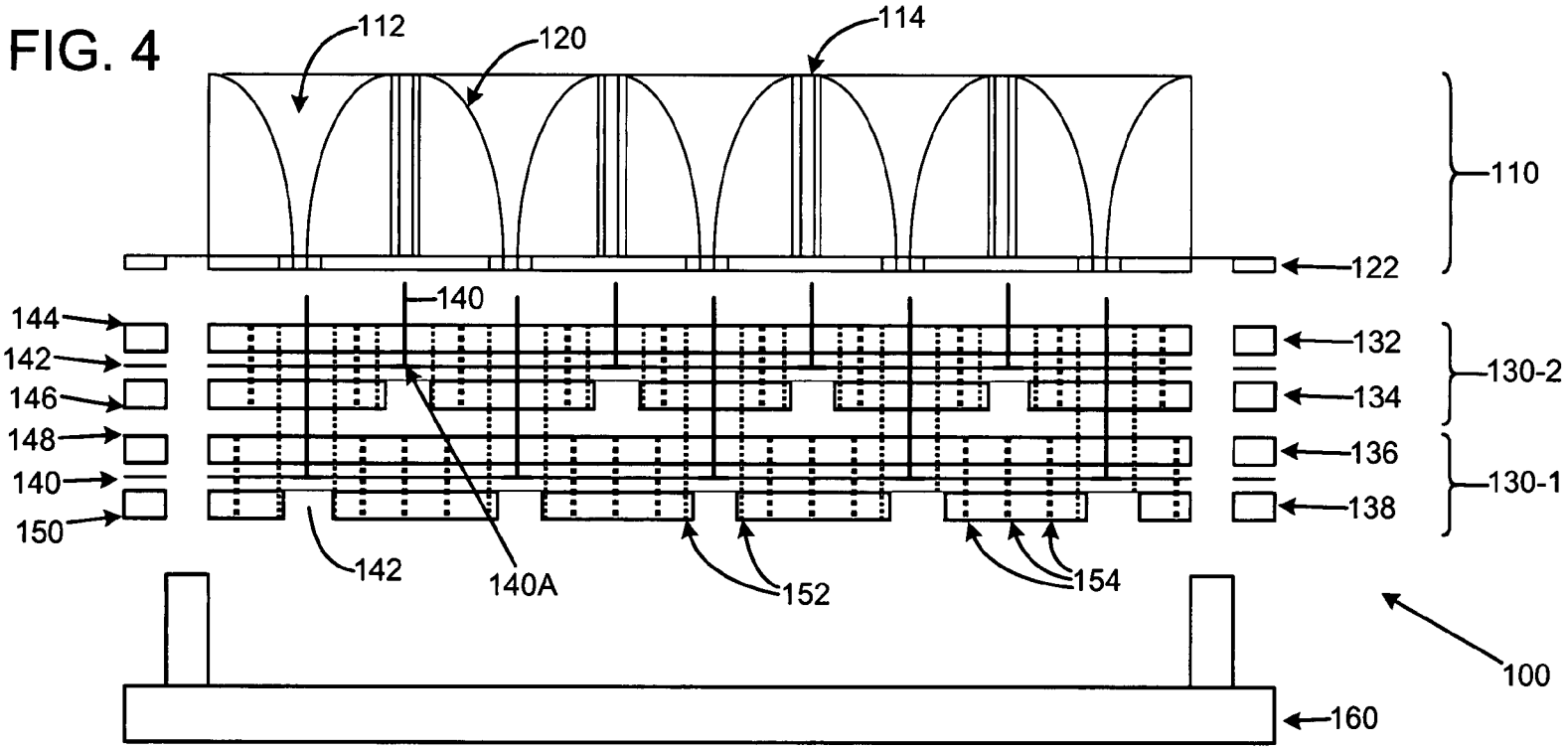
FIG. 4 is an exploded side view illustration of an antenna assembly employing a foam-loaded stripline transmission line structure.

FIG. 4 is an exploded side view illustration of an antenna assembly 100 employing a radiator assembly 110 and a foam-loaded stripline transmission line structure 130. The radiator assembly includes orthogonal polarization radiator sticks 112, 114 arranged in an egg-crate-like structure. The radiator sticks include dielectric substrates on which are formed flared radiators 120. The radiator sticks are assembled to a dielectric substrate 122, which in an exemplary embodiment may be fabricated from Kevlar®.

In an exemplary embodiment, the radiator assembly 110 is electrically connected to two RF feed circuits provided by the structure 130, by feed pins 140 which extend in a transverse direction to the structure 130. The feed pins are electrically connected to baluns formed in the radiator assembly 110, and to the respective ones of the RF feed circuits formed in the structure 130 by pin heads 140A.

The structure 140 defines first and second RF feeds 130-1 and 130-2, which respectively provide feed circuits for the orthogonal radiator sticks 112 and 114. Each of the feed circuits may be fabricated as a foam layer stack-up, similar to that depicted in FIG. 1. Thus, feed circuit 130-1 includes dielectric foam spacer layers 136, 138, and a center RF circuit layer 140 located between the foam spacer layers. Upper and lower ground plane layers 148, 150 are disposed outside the foam spacer layers.

Feed circuit 130-2 includes dielectric foam spacer layers 132, 134, and a center RF circuit layer 142 located between the foam spacer layers. Upper and lower ground plane layers 144, 146 are disposed outside the foam spacer layers.

In an exemplary embodiment, the layers of the structure 110 and the structure 130 may be assembled together with the aid of tooling such as fixture 160, and the layers secured together with adhesive such as, for example, RS-4A adhesive film marketed by YLA, Inc., Benicia, Calif. Exemplary materials for the structure 130 include Rohacell 31-HF-HT foam for the foam spacer layers, 0.001 inch thick LCP with 0.0007 inch thick copper traces as the RF circuit layers, and 0.001 inch thick KaptonE® substrate with 0.00035 inch thick copper cladding as the ground plane layers. These specific layer materials and thicknesses are intended only as examples.

In the exemplary embodiment of FIG. 4, coaxial cage wire stitching 152 is employed around the feed pins 140, with the feed pins forming the center conductor of a vertical coaxial line interconnect. Mode suppression wire stitching 154 is employed on opposite sides of stripline conductors to provide mode suppression. The wire stitching may be provided by copper wire, 0.004 inch thick, and conductive epoxy to ensure good electrical contact with the ground planes.

Although the foregoing has been a description and illustration of specific embodiments of the invention, various modifications and changes thereto can be made by persons skilled in the art without departing from the scope and spirit of the invention as defined by the following claims.

What is claimed is:

1. A transmission line structure for propagating electromagnetic energy, comprising:

a transmission line conductor trace;

a first dielectric foam layer and a second dielectric foam layer;

said conductor trace sandwiched between said first foam layer and said second foam layer;

a first ground plane layer and a second ground plane layer sandwiching the first foam layer, the conductor trace and the second foam layer; and a plurality of mode suppression metallic element portions passing through the first ground plane layer, the first foam layer, the second foam layer and the second ground plane layer in a generally transverse arrangement, each metallic element portion electrically connected to the first ground plane layer and the second ground plane layer;

wherein the plurality of mode suppression metallic element portions comprise a metallic wire stitched through a plurality of holes in the first ground plane layer, the first foam layer, the second foam layer and the second ground plane layer.

2. The structure of claim 1, wherein the first ground plane layer and the second ground plane layer each comprise an electrically conductive layer on a substrate.

3. The structure of claim 1, wherein the first ground plane layer and the second ground plane layer each comprise an electrically conductive layer deposited on a foam layer surface.

4. The structure of claim 3, wherein said electrically conductive layer is a metal layer deposited on the foam layer surface by electron beam evaporation.

5. The structure of claim 1, further comprising:

a vertical interconnect center conductor extending from the conductor trace through an opening in the first foam layer and an opening formed in the first ground plane layer, wherein the mode suppression metallic element portions are arranged to form a coaxial cage conductor structure in a peripheral arrangement around the center conductor.

6. The structure of claim 1, wherein the conductor trace is formed on a dielectric substrate.

7. The structure of claim 1, wherein said conductor trace, said first dielectric foam layer and said second dielectric foam layer are adhesively secured together in a stack-up configuration.

8. The structure of claim 1, wherein said transmission line conductor trace, said first dielectric foam layer, said second dielectric foam layer, and said first ground plane layer and said second ground plane layer are cooperatively arranged to provide a stripline transmission line structure.

9. The structure of claim 1, wherein the first foam layer and second foam layer are fabricated from ultra light weight foam material with a weight less than about 3 pounds per cubic foot.

10. The structure of claim 1, wherein the mode suppression metallic element portions are arranged in a spaced arrangement to form electrically conductive picket structures along the transmission line conductor trace as electrically conductive boundary wall structures.

11. The structure of claim 1, wherein the metallic wire is copper wire.

12. The structure of claim 1, further comprising conductive epoxy in regions of contact between the first ground plane layer and the metallic wire and between the second ground plane layer and the metallic wire.

13. An antenna array, including a radiator array and a feed network electrically connected to the radiator array, and wherein the feed network includes a transmission line structure for propagating electromagnetic energy, comprising:

a transmission line conductor trace;

a first dielectric foam layer and a second dielectric foam layer;

said conductor trace sandwiched between said first foam layer and said second foam layer;

a first ground plane layer and a second ground plane layer sandwiching the first foam layer, the conductor trace and the second foam layer; and a plurality of mode suppression metallic element portions passing through the first ground plane layer, the first foam layer, the second foam layer and the second ground plane layer in a generally transverse arrangement, each metallic element portion electrically connected to the first ground plane layer and the second ground plane layer;

wherein the plurality of mode suppression metallic element portions comprise segments of a metallic wire stitched through a plurality of holes in the first ground plane layer, the first foam layer, the second foam layer and the second ground plane layer.

14. The array of claim 13, wherein the first ground plane layer and the second ground plane layer each comprise an electrically conductive layer on a substrate.

15. The array of claim 13, wherein the first ground plane layer and the second ground plane layer each comprise a metal layer deposited on a foam layer surface.

16. The array of claim 13, further comprising:

a vertical interconnect center conductor extending from the conductor trace through an opening in the first foam layer and an opening formed in the first ground plane layer to a connection with the radiator array, wherein the mode suppression metallic element portions are arranged to form a coaxial cage conductor structure in a peripheral arrangement around the center conductor.

17. The array of claim 13, wherein said conductor trace, said first dielectric foam layer and said second dielectric foam layer are adhesively secured together in a stack-up configuration.

18. The array of claim 13, wherein the metallic element portions are arranged in a spaced arrangement to form electrically conductive picket structures along the transmission line conductor trace as electrically conductive boundary wall structures.

19. A method for fabricating a foam loaded stripline transmission line structure, comprising:

sandwiching a circuit layer carrying a conductor trace between dielectric lightweight first and second foam layers;

sandwiching the foam layers between first and second ground planes; and installing a plurality of mode suppression metallic element portions through the first ground plane layer, the first foam layer, the second foam layer and the second ground plane layer in a generally transverse arrangement, each metallic element portion electrically connected to the first ground plane layer and the second ground plane layer, wherein said installing a plurality of mode suppression metallic element portions includes:

stitching a continuous metallic wire through a plurality of holes in the first ground plane layer, the first foam layer, the second foam layer and the second ground plane layer to form wire stitches.

20. The method of claim 19, wherein the metallic element portions are arranged in a spaced arrangement to form electrically conductive picket structures along the conductor trace as electrically conductive boundary wall structures.

21. The method of claim 19, wherein said installing a plurality of mode suppression metallic element portions includes:

bonding the wire stitches in place.

22. The method of claim 19, further comprising:

forming a vertical interconnect center conductor extending from the conductor trace through an opening in the first foam layer and an opening formed in the first ground plane layer, and wire stitching a coaxial cage conductor structure in a peripheral arrangement around the center conductor.

23. The method of claim 19, wherein said sandwiching the foam layers between first and second ground planes includes:

depositing metal layers on respective outwardly facing surfaces of the foam layers.

* * * * *